United States Patent [19]

Uehara et al.

[11] 4,266,503

[45] May 12, 1981

[54] APPARATUS FOR FORMING A CLOUD OF TONER PARTICLES

[75] Inventors: Tsutomu Uehara, Yokosuka; Toshihiko Oguchi, Kawasaki; Tsutomu Kubo, Yokohama; Yukio Suzuki, Ayase; Toshiharu Nakagawa, Yokohama; Ichiyoshi Saito, Tokyo, all of Japan

[73] Assignee: Tokyo Shibaura Denki Kabushiki Kaisha, Tokyo, Japan

[21] Appl. No.: 40,141

[22] Filed: May 18, 1979

[30] Foreign Application Priority Data

May 25, 1978 [JP] Japan ..... 53/62513

[51] Int. Cl.[3] ..... G03G 13/09; G03G 15/09

[52] U.S. Cl. ..... 118/657; 118/603; 209/226

[58] Field of Search ..... 209/212, 218, 215, 219, 209/226, 227; 118/603, 642, 610, 657, 658; 355/3 DD; 430/122

[56] References Cited

U.S. PATENT DOCUMENTS

| | | | |
|---|---|---|---|
| 758,655 | 5/1904 | Imlay | 209/226 X |
| 2,470,889 | 5/1949 | Drescher | 209/226 X |
| 3,291,305 | 12/1966 | Tenpas et al. | 209/226 X |
| 3,645,770 | 2/1972 | Flint | 118/657 X |
| 3,703,395 | 11/1972 | Drexler et al. | 118/658 X |
| 3,707,389 | 12/1972 | Maksymiak et al. . | |
| 3,882,822 | 5/1975 | Sullivan, Jr. . | |
| 3,962,992 | 6/1976 | Takagi et al. . | |
| 4,122,209 | 10/1978 | Kinard | 118/657 X |

*Primary Examiner*—John P. McIntosh
*Attorney, Agent, or Firm*—Oblon, Fisher, Spivak, McClelland & Maier

[57] ABSTRACT

An apparatus for forming a cloud of magnetic toner particles has a rotatable magnet roller with a number of magnetic poles disposed within a non-magnetic cylindrical sleeve. Magnetic toner particles are supplied from a hopper onto the sleeve. A magnetic bar is disposed above the sleeve. The rotation of the magnet roller causes the sleeve to carry magnetic toner particles thereon. When the magnetic toner particles carried approach to the magnetic bar, those become in a cloudy state.

14 Claims, 6 Drawing Figures

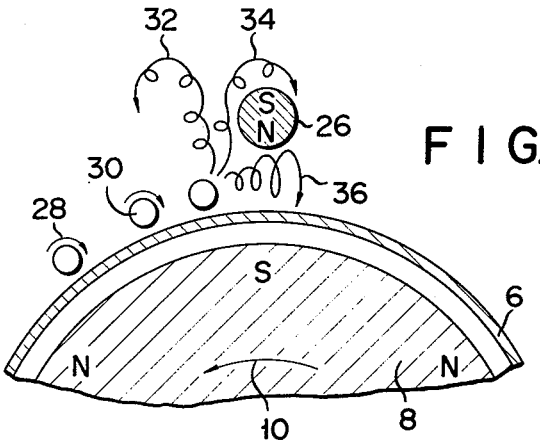
FIG. 3
FIG. 4
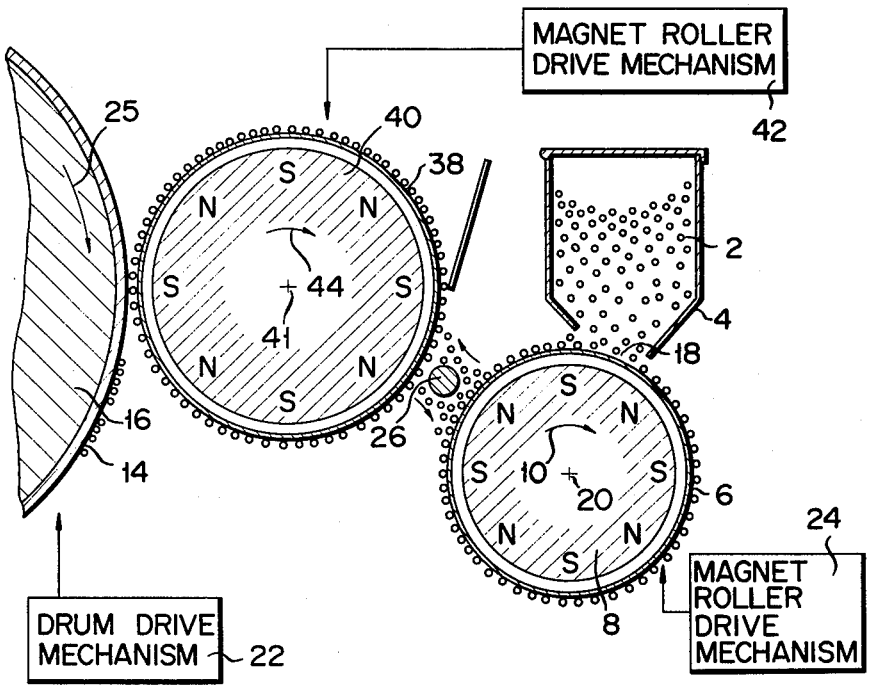

APPARATUS FOR FORMING A CLOUD OF TONER PARTICLES

BACKGROUND OF THE INVENTION

The invention relates to an apparatus for forming a cloud of magnetic toner particles and, more particularly, improvement of an apparatus for forming a cloud of one-component type developer, or magnetic toner particles in an apparatus for developing electrostatic latent image or an apparatus for selectively separating toner particles into magnetic and non-magnetic toner particles.

There have been various types of apparatus for supplying toner particles onto a photoelectroconductive layer surface with an electrostatic charged image formed thereon, for example, U.S. Pat. Nos. 3,645,770, 3,707,389, 3,882,822 and 3,962,992. U.S. Pat. No. 3,962,992, discloses the principle for forming a layer of cloud of toner particles by rotating and repeatedly rebounding toner particles in the alternating magnetic field. The developing apparatus using the alternating magnetic field employs a one-component type developer, or magnetic toner particles each of which is made of magnetic particle covered with resin colored by an agent. Such a developing apparatus will be described in more detail referring to FIG. 1. As shown in FIG. 1, the developing apparatus is comprised of a hopper 4 for supplying magnetic toner or developer 2, and a cylindrical non-magnetic sleeve 6 supplied with magnetic toner particles 2 from the hopper 4, and a magnet roller 8 disposed within the sleeve 6. The magnet roller 8 is provided with a number of magnetic poles N and S alternately arranged on the roller surface. The magnet roller 8 is rotated in a direction of an arrow 10 or the cylindrical sleeve 6 is rotated in a reverse direction with respect to arrow 10, for forming an alternating magnetic field on the sleeve surface. The magnetic toner particles 2 supplied from the hopper 4 fall onto the sleeve surface due to the forces of gravity and of the magnetic force. The toner particles on the sleeve surface are carried with the rotation of the roller 8 or the sleeve 6. The thickness or height of the carrying particles 2 from the sleeve surface are uniformly controlled by a doctor blade 12 which is disposed above the sleeve surface and upstream of the hopper 4. The toner particles 2 are carried to contact with a photoconductive layer 14 of a rotating drum 16 or a photoconductive paper (not shown) so that the toner particles 2 are attached onto the surface of the layer 14 to visualize electrostatic latent images already formed thereon.

In this type of developing apparatus, it is difficult to always keep constant an amount of carrying magnetic toner particles 2 with a proper particle density on the sleeve surface. The result is that the cloud of particles are not uniformly contacted with the photoconductive layer 14. This uneveness is distinguished, particularly when the toner particles are poor in fluidity and when an aggregation or conglomerate of particles are included in the magnetic toner particles since the amount of the carrying particles is not uniform.

SUMMARY OF THE INVENTION

Accordingly, an object of the present invention is to provide an apparatus capable of forming a cloud of toner particles with a proper magnetic toner particle density and a relatively uniform particle density distribution.

According to one aspect of the present invention, there is provided an apparatus for forming a cloud of toner particles involving means for developing an alternating magnetic field, means for supplying magnetic toner particles into the alternating magnetic field, and a magnetic member disposed in the alternating magnetic field to form a cloud of toner particles therearound with a proper magnetic toner particle density.

In accordance with another aspect of the invention, there is provided an apparatus for developing an electrostatic latent image comprising means for developing an alternating magnetic field, means for supplying magnetic toner particles into the alternating magnetic field, a magnetic member disposed in the alternating magnetic field to form a cloud of toner particles therearound with a proper magnetic toner particle density , magnetic toner particle carrying means which is contacted with the cloud of magnetic toner particles and onto which the toner particles is transferred, and a photoconductive member of which an electrostatic latent image formed thereon is visualized by the magnetic toner particles supplied from the magnetic toner particle carrying means.

According to still another aspect of the invention, there is provided an apparatus for selectively separating toner particles into magnetic and non-magnetic toner particles comprising means for developing an alternating magnetic field, means for supplying magnetic toner particles into the alternating magnetic field, a magnetic member disposed in the alternating magnetic field to form a cloud of toner particles therearound with a proper magnetic toner particle density, and magnetic toner particle carrying means which contacts with the cloud of magnetic toner particles to carry only the magnetic toner particles.

Other objects and features of the invention will be apparent from the following description taken in connection with the accompanying drawings, in which

BRIEF DESCRIPTION OF THE DRAWINGS

FIG. 3 shows a schematic cross sectional view for illustrating the principle of the apparatus according to the invention;

FIGS. 4 and 5 show schematic cross sectional views of other embodiments of the apparatus for developing electrostatic latent images according to the invention.

DETAILED DESCRIPTION OF THE PREFERRED EMBODIMENT

Figure 1:
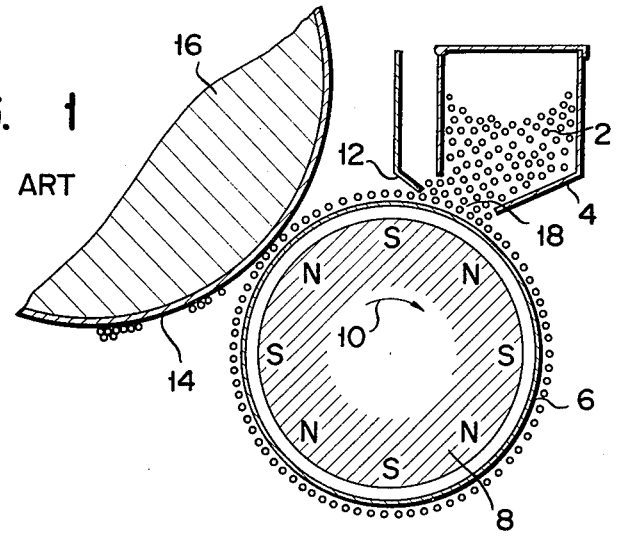
FIG. 1 PRIOR ART
FIG. 1 shows a schematic cross sectional view of one example of a conventional apparatus for developing electrostatic latent image.
Figure 2:
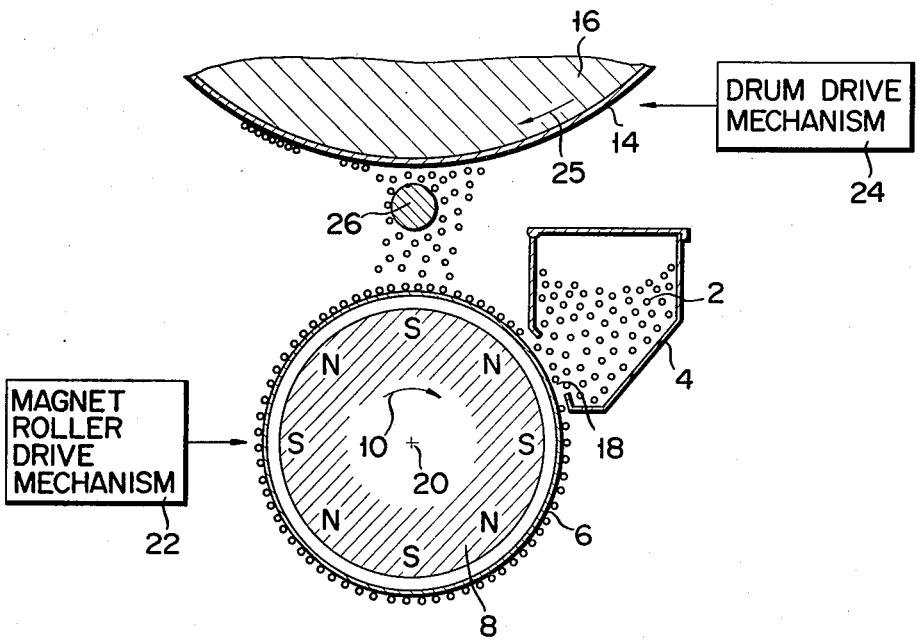
FIG. 2 shows a schematic cross sectional view of an apparatus for developing electrostatic latent images into which an apparatus for forming a cloud of toner particles according to the invention is incorporated.

Reference is first made to FIG. 2 illustrating a developing apparatus employing an apparatus for forming a cloud of toner particles according to the invention. In the figure, like numerals are used to designate like portions in FIG. 1. In FIG. 2, one component type developer, or magnetic toner particle 2 is charged in a hopper Provided close to the opening 18 of the hopper 4 is a cylindrical sleeve 6 made of non-magnetic material such as aluminum. Within the cylindrical sleeve 6 is provided a cylindrical roller 8 rotatable in the direction of an arrow 10. The magnet roller 8, which is rotated by a drive mechanism 22, has eight magnetic poles N and S disposed symmetrically with respect to the axis 20. Alternately, the cylindrical sleeve 6 may be rotated by the drive mechanism 22 around the roller 8 fixed, in place of rotating the roller 8. The rotating direction of the roller 8 or the sleeve 6 is not limited to the arrow 10 but the inverse direction of the arrow is permitted. A magnetic field on and above the surface of the cylindrical sleeve 6 is developed by the magnet roller and an alternating magnetic field on and above the surface of the cylindrical sleeve 6 is developed by the rotation of the roller 8 or the sleeve 6. A drum 16 with a photoconductive layer 14 formed thereon is close to the cylindrical sleeve 6 with a given separation therebetween. The drum is rotated by a drive mechanism 24 in the direction of an arrow 25. Electrostatic latent images are formed on the photoconductive layer 14 and are visualized by toner particles 2 stuck thereto. Disposed in the space between the photoconductive layer 14 and the cylindrical sleeve 6 is a magnetic bar 26 as a developing electrode which is made of, for example, iron Fe, cobalt Co, nickel Ni or an alloy of these materials. In this example, a cylindrical bar is used but any other suitable shape, for example, a rectangular bar, is permitted for the electrode bar. The presence of the electrode bar 26 moves magnetic toner particles 2 in various manners in the space around the magnetic bar 26 so that the density of the magnetic toner particles changes to form a relatively thin toner cloud therearound.

How the toner particle cloud is formed around the bar 26 will be described with reference to FIG. 3. With rotation of the magnet roller 8, an alternating magnetic field is developed on and above the surface of the sleeve 6. When toner particles 2 are supplied to such a sleeve surface 6, an individual toner particles move while rotating, in the reverse direction to the roller rotating direction 10, and bounce on the sleeve 6 thereby to form a thin cloud above the sleeve surface. When the cloudy toner particles approach to the magnetic bar 26, the motions of the toner particles change. The toner particles in the vicinity of the magnetic bar 26 generally take three motions. Force is exerted on toner particles 2 to rotate them in the opposite direction to that of the particle rotation so that the toner particles crisply scatter like dust flies, as indicated by numeral 32. The scattered toner particles 2 move along the surface of the magnetic bar 26 under the influence of the magnetic field from the magnetic bar 26, as indicated by numeral 34. Further, the flying particles move, vibrating between the sleeve 6 and the magnetic bar 26, as indicated by numeral 36. In addition to those movements, toner particles 2 collide with one another to move randomly. In this way, toner particles 2 move in complicated and various directions to form a more uniform and thinner cloud of toner particles around the magnetic bar 26. The reason why toner particles move in various direction is that the magnetic bar 26 is inductively magnetized to change the magnetic field around the bar 26 and then the changed magnetic field again influences toner particles 2. For example, when the magnetic pole S is disposed right under the bar 26, the bar 26 is magnetized as shown in the figure. The magnetizing state of the bar 26 changes with the rotation of the roller 8. Accordingly, the magnetic field around the bar 26 changes so that toner particles move in a varied manner.

With the rotation of the drum 16 driven by the drive mechanism 24, the photoconductive layer 14, layered on the drum surface, moves in contact with the thin and uniform particle cloud drifting in the space near the bar 26. Accordingly, the electrostatic latent images already formed on the layer 14 are visualized by the toner particles. The particle cloud has a proper density of toner particles with uniformly dispersed particles of uniform particle density. Therefore, the image visualized is accurate and clear. The amount of the toner particles in contact with the photoconductive layer 14 depends on the magnetic characteristic of the toner particles, the magnetic force, the number of the magnetic poles and the number of rotations of the roller 8, the magnetic characteristic of the bar 26, and the relative positions among the bar 26, the roller 8 and the layer 14. Accordingly, the amount of the toner particles 2 is adjustable by properly selecting these factors.

Turning now to FIG. 4, there is shown a modification of the developing apparatus shown in FIG. 3. In this embodiment, a cylindrical sleeve 38 for carrying toner particles is disposed between the photoconductive layer 14 and the sleeve 6. The sleeve 38 is made of non-magnetic material and has a magnet roller 40 having an axis 41 with a number of magnetic poles disposed therein. Either of the roller 40 or the sleeve 38 is rotatable around the axis 41 by a drive mechanism 42 in the direction of an arrow 44. The roller or sleeve rotaton produces an alternating magnetic field in the space above the sleeve 38.

In the embodiment shown in FIG. 4, magnetic toner particles 2 supplied from the hopper 2 are carried on the sleeve surface and crisply scattered from the sleeve surface under the influence of the magnetic bar thereby being transferred onto the surface of the sleeve 38. The alternate magnetic field developed on the sleeve surface then carries the toner particles laying on the sleeve surface 38 and then transfers them onto the surface of the photoconductive layer 14.

The embodiment shown in FIG. 4 can supply toner particles 2 onto the photoconductive layer 14 at a more fixed rate than the embodiment in FIG. 2. Additionally, there is little possibility that aggregated toner particles 2 are supplied onto the photoconductive layer 14.

Figure 5:
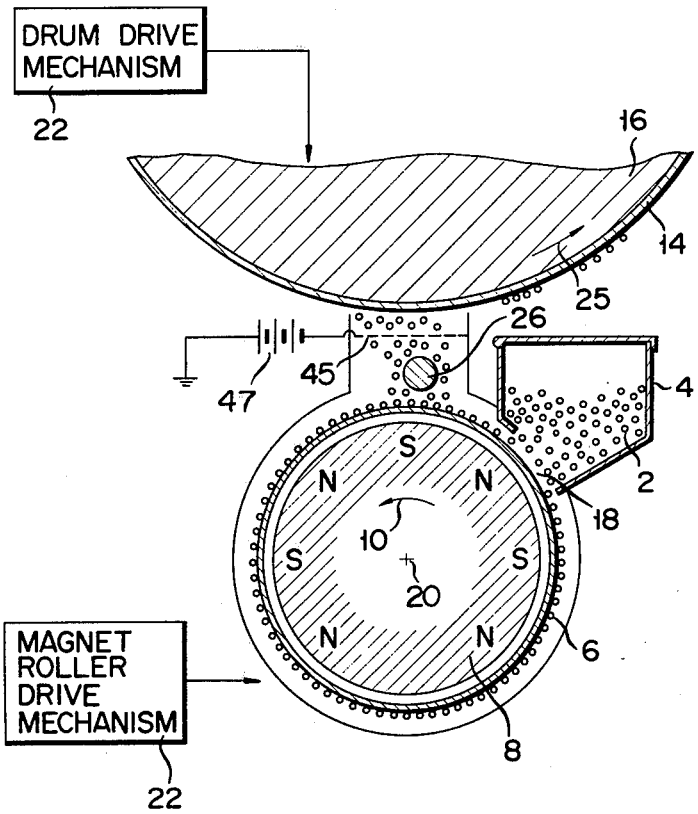

In the FIG. 4 embodiment, the sleeve 38 and magnet roller 40 combination may be replaced by a cylindrical sleeve with such a rough surface of which the depressions are each substantialy equal to or larger than the particle diameter of a toner particle. When such a sleeve comes in contact with the toner particle cloud, toner particles are shallowly fitted in the surface depressions of the sleeve so that a thin toner particle layer is formed. With the rotation of the sleeve, the toner particles are transferred onto the surface of the photoconductive layer 14. FIG. 5 shows a modification of the developing apparatus shown in FIG. 2. The embodiment employs a wire grid 45 which is connected to an electrical source 47 and disposed between the sleeve 6 and the photoconductive layer 14. A high electrical field is produced between the wire grid 45 and the photoconductive layer 14 by applying a high voltage to the wire grid from the electrical source 47, thereby floating the toner particles in the space between the wire grid 45 and the photoconductive layer 14. The presence of the high electric field makes the image visualized on the layer 14 more clearer and fine.

Figure 6:
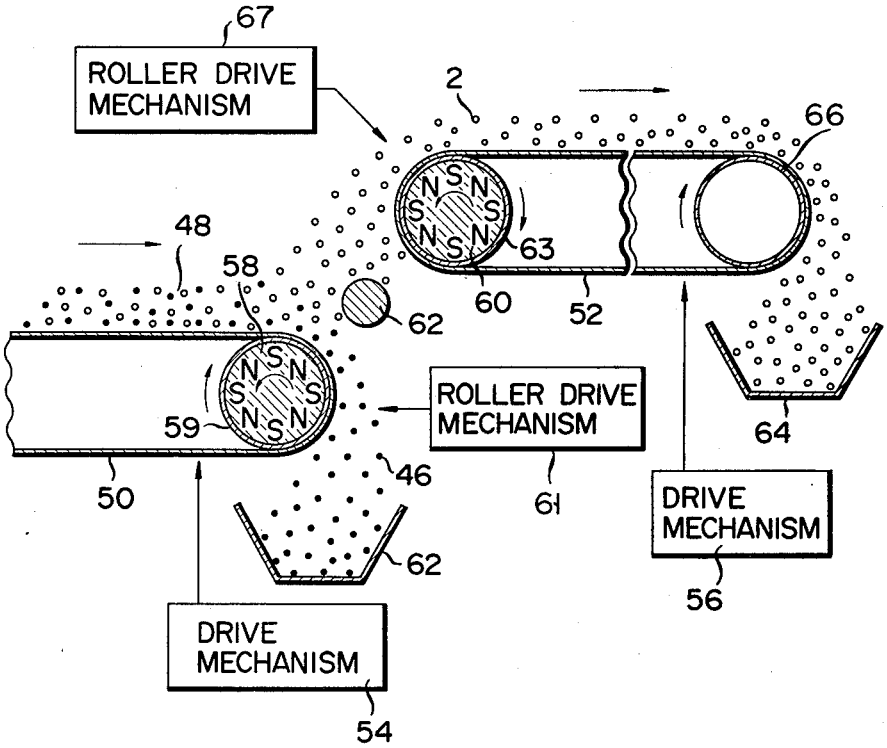
FIG. 6 schematically illustrates in cross sectional form an apparatus for selectively separating toner particles into magnetic and non-magnetic toner particles, in which the apparatus for forming a cloud of toner particles according to the invention is incorporated.

FIG. 6 shows an example of a separating apparatus for selectively separating toner particles into magnetic and non-magnetic toner particles, which is combined with the apparatus for forming a cloud of toner particles. The separating apparatus is comprised of a first conveyor 50 for carrying toner particles 48 containing magnetic toner particles 2 and non-magnetic particles 46, and a second conveyor 52 carrying only selected toner particles 48. In the figure, black dots indicate magnetic toner particles 46 while white small circles magnetic toner particles 2. The first and second conveyors 50 and 52 are driven by first and second drive mechanisms 54 and 56, respectively. A non-magnetic cylindrical sleeve 59 with a magnet roller 58 therein is located at the toner particles feeding end of the first conveyor 50. The sleeve 59 is rotated by the conveyor 50 and the magnet roller 58 with a number of magnet poles N and S therearound is rotated by a roller drive mechanism 61 in the opposite direction to that of the sleeve 59. Similarly, a cylindrical sleeve 63 made of non-magnetic material with a magnet roller 60 therein is located at the conveyor end of the second conveyor 52 which is diposed near the particle supply end of the first conveyor 50 and a cylindrical sleeve 66 made of non magnetic material is located at the magnetic toner particle feeding end of the second conveyor 52. A magnetic bar 62 is disposed between the sleeves 59 and 63, as shown. The sleeves 63, 66 are rotated by the conveyor 52 while the roller is rotated by a drive mechanism 67 in the opposite direction to that of the sleeve 63. Dish-like receptacles 54 and 64 respectively are disposed below the particle supply ends of the first conveyor 50 and the second conveyor 52 for the purpose of receiving particles falling from the respective ends.

With such an arrangement, toner particles 48 are carried by the conveyor 50 to reach above the roller 58 where magnetic toner particles 2 become cloud-like while non-magnetic particles fall directly into the receptacle 62. The cloudy magnetic toner particles 2 become more cloudy as they approach the bar 62, to crisply scatter toward the magnet roller 60. The magnetic toner particles 2 become cloudy on the magnet roller 60 and then are transferred by the second conveyor 52 to the particle supply end of the conveyor 52. The magnetic toner particles 2 are discharged at the particle supply end of the conveyor 52 into the receptacle 64. The particle separating apparatus shown in FIG. 6 can reliably separate non-magnetic particles as impurity, from the toner particles 48 in the toner particle manufacturing stage.

As described above, the invention can form a cloud of magnetic toner particles with uniform particle density, so that it can stably carry magnetic toner particles with the uniform particle density distribution. Therefore, if the invention is applied to the magnetic brush development, the cascade development, the smoke or cloud development, the touch-down development, the impression development and the like, the electrostatic latent image of an electrophotograph or the like by using magnetic toners as one-component type developer may be stabilized, securing high quality development.

What we claim is:

1. An apparatus for forming a cloud of toner particles comprising:

means for supplying magnetic toner particles;

a tubular sleeve made of non-magnetic material the surface of which is supplied with magnetic toner particles from said supplying means;

a rotatable magnet roller with a predetermined number of magnet poles disposed within said tubular sleeve;

drive means for rotating said rotatable magnet roller in one direction, said magnet roller forming, on being rotated, an alternating magnetic field on the surface of said tubular sleeve, thereby carrying said magnetic toner particles around the surface of said tubular sleeve; and a magnetic member located adjacent said rotatable magnet roller and being disposed in the alternating magnetic field to form a cloud of particles from said of the carried toner paticles.

2. An apparatus for forming a cloud of toner particles according to claim 1, wherein said magnetic member is a ferromagnetic bar.

3. An apparatus for forming a cloud of toner particles comprising:

means for supplying magnetic toner particles;

a tubular sleeve made of non-magnetic material the surface of which is supplied with magnetic toner particles from said supplying means;

a rotatable magnet roller with a predetermined number of magnet poles disposed within said tubular sleeve;

drives means for rotating said rotatable magnet roller in one direction, said magnet roller forming, on being rotated, an alternating magnetic field on the surface of said tubular sleeve, thereby carrying said magnetic toner particles around the surface of said tubular sleeve;

a magnetic member located adjacent said rotatable magnet roller and being disposed in the alternating magnetic field to form a cloud of particles from some of the carrier toner particles; and a photoconductive member located adjacent said magnetic member which comes in contact with the cloud of magnetic toner particles to visualize an electrostatic latent image formed thereon.

4. An apparatus for developing an electrostatic latent image according to claim 3, wherein said magnet member is ferromagnetic bar.

5. An apparatus for developing an electrostatic latent image according to claim 3, wherein said photoconductive member is a photoconductive layer which is provided on a drum and said apparatus for developing an electrostatic latent image further comprises means for rotating the drum.

6. An apparatus for developing an electrostatic latent image according to claim 3, further comprises a wire grid to which a high voltage is applied and a high voltage source for developing an electrical field with a high intensity between said wire grid and a photoconductive member.

7. An apparatus for forming a cloud of toner particles comprising:

means for supplying magnetic toner particles;

a tubular sleeve made of non-magnetic material the surface of which is supplied with magnetic toner particles from said supplying means;

a rotatable magnet roller with a prederermined number of magnet poles disposed within said tubular sleeve;

drive means for rotating said rotatable magnet roller in one direction, said magnet roller forming, on being rotated, an alternating magnetic field on the surface of said tubular sleeve, thereby carrying said magnetic toner particles around the surface of said tubular sleeve;

a magnetic member located adjacent said rotatable magnet roller and being disposed in the alternating magnetic field to form a cloud of particles from some of the carried toner particles;

magnetic toner particle carrying means located adjacent said magnetic member which is contacted with the cloud of magnetic toner particles to have magnetic toner particles tranferred thereonto; and a photoconductive member on which an electrostatic latent image formed thereon is visualized by the magnetic toner particles supplied from said magnetic toner particle carrying means which is located adjacent thereto.

8. An apparatus for developing an electrostatic latent image according to claim 7, wherein said magnetic particle carrying means is comprised of a magnet roller with a number of magnetic poles, a non-magnetic cylindrical sleeve with said magnet roller therein, and a rotating means for rotating at least one of said magnet roller and said cylindrical sleeve.

9. An apparatus for developing an electrostatic latent image according to claim 7, wherein said magnetic toner particle carrying means is a member with such a rough surface as to permit magnetic toner particles to shallowly be fitted in the depressions thereof.

10. An apparatus for developing an electrostatic latent image according to claim 7, wherein said magnetic member is a ferromagnetic bar.

11. An apparatus for developing an electrostatic latent image according to claim 7, wherein said photoconductive member is a photoconductive layer which is provided on a drum and said apparatus for developing an electrostatic latent image further comprises means for rotating the drum.

12. An apparatus for separating toner particles into magnetic toner particles and non-magnetic toner particles comprising:

means for supplying the toner particles;

a first tubular sleeve made of non-magnetic material, the toner particles being supplied from said supplying means onto said tubular sleeve;

a first rotatable magnet roller with a predetermined number of magnet poles disposed within said first tubular sleeve;

first means for rotating said first magnet roller in one direction, said first rotatable magnet roller forming, on being rotated, an alternating magnetic field on the surface of said first tubular sleeve, thereby carrying only the magnetic toner particles of the toner particles around the surface of said first tubular sleeve;

a magnetic member located adjacent said first rotatable magnet roller and being disposed in the alternating magnetic field to form a cloud of particles from some of the carried magnetic toner particles; and means for carrying magnetic toner particles located adjacent said magnetic member and being contacted with the cloud of magnetic toner particles to carry only the magnetic toner particles.

13. An apparatus for separating toner particles into magnetic toner particles and non-magnetic toner particles according to claim 12, wherein said toner particle supplying means includes a first conveyor means for transferring the toner particles onto said first non-magnetic sleeve, said first non-magnetic sleeve being rotated by the first conveyor means in the opposite direction to that of said first magnet roller; and said magnetic toner particle carrying means includes a second tubular sleeve made of non-magnetic material on which the cloud of magnetic toner particles is formed, a second rotatable magnet roller with a predetermined number of magnet poles disposed within said second tubular sleeve, second drive means for rotating said second rotatable magnet roller in one direction, said second magnetic roller forming, on being rotated, an alternating magnetic field on the surface of said second tubular sleeve, thereby carrying only the magnetic toner particles in the cloud of particles around the surface of said second tubular sleeve, and a second conveyor means for transferring the magnetic toner particles carried by the rotation of said second magnet roller.

14. An apparatus for separating toner particles into magnetic toner particles and non-magnetic particles according to claim 12 wherein said magnetic member is a ferromagnetic bar.

* * * * *